United States Patent [19]

Murray

[11] Patent Number: 4,699,189

[45] Date of Patent: Oct. 13, 1987

[54] PRESSURIZING CAP

[76] Inventor: William K. Murray, 3808 Cookson Rd., Fairmont City, Ill. 62201

[21] Appl. No.: 901,295

[22] Filed: Sep. 2, 1986

[51] Int. Cl.[4] ..... B65B 31/04

[52] U.S. Cl. ..... 141/64; 141/70; 141/302; 141/326; 126/52; 137/209; 220/DIG. 33

[58] Field of Search ..... 220/DIG. 33, 209, 254; 137/209; 126/52, 39 N, 49; 141/1-12, 37-70, 285-310, 325-327

[56] References Cited

U.S. PATENT DOCUMENTS

| | | | |
|---|---|---|---|
| 1,429,566 | 9/1922 | Carlile | 220/DIG. 33 |
| 1,988,404 | 1/1935 | Varese | 220/DIG. 33 |
| 3,361,298 | 10/1965 | Trumble | 222/399 |
| 3,596,809 | 8/1971 | Taubenheim | 222/399 |
| 3,626,476 | 12/1971 | Trumble | 222/399 |
| 4,281,422 | 8/1981 | Simonelli | 138/89.1 |
| 4,431,326 | 2/1984 | Braithwaite | 222/399 |

*Primary Examiner*—Houston S. Bell, Jr.
*Attorney, Agent, or Firm*—Don W. Weber

[57] ABSTRACT

A combined camp stove or camp lantern fuel tank reservoir cap and pressurizing assembly is presented in which a fuel tank cap body is adapted to include a hollow check-valve assembly base on the top thereof. Into the check-valve assembly base is inserted a check valve assembly. The cap body has an aperture therein so as to be fluidly connected to the base when a compressed air nipple from a hose is inserted into the check-valve assembly. The compressed air flows through the base, past a gasket in the body having a slit therein for air passage and through the body to pressurize a fuel reservoir.

11 Claims, 5 Drawing Figures

PRESSURIZING CAP

BACKGROUND OF THE INVENTION

This invention relates to a cap for fuel tanks which enables the user to pressurize the contents of the fuel tank by means of applying compressed air through an air hose.

The present invention represents a distinct improvement over standard pressurizing devices and will be most frequently used on camp stoves, lanterns and other portable fuel tanks. Although the pressurizing cap is ideally suited for use on such portable stoves and lanterns, it can also be of great value in use on stationary fuel tanks and similar devices wherein the pressurization of a fuel tank reservior is necessary.

In the past, hand pumps were devised to pressurize the fuel tanks. Other inventions have made design changes to this method of pressurizing fuel tanks. A fuel tank pressurizing device dissimilar to the present invention can be found in Trumble U.S. Pat. No. 3,626,476. The Trumble uses a pressurized gas cylinder to pressurize the fuel tank.

While other methods of pressurizing fuel tanks are currently in use, the present invention has features not available in other devices. The present invention does not use pressurized cylinders and hence the cost, inconvenience and need to periodically replace the cylinder is not present. Because the pressurizing cap needs to be pressurized only once for an average camping trip constant pumping of a hand-pump is eliminated. The check-valve assembly base is small and hence makes the fuel tank and stove or lantern more compact and easier to store. Since the design of the pressurizing cap is simple, maintenance is easier. The new method herein disclosed also increases the pressure in the fuel reservoir which results in a brighter lantern or a hotter flame on a camp stove.

SUMMARY OF THE INVENTION

It is an object of this invention to provide a unique fuel tank pressurizing cap which will enable a person to pressurize a fuel tank reservoir by one application of a pressurized air supply using a standard check-valve assembly and standard air hose such as are widely available in service stations throughout the world. The structure of the cap is simple and easy to maintain and the cap's function provides a brighter wick, a hotter stove and more efficient use of fuel.

A novel concept of this invention relates to the combination of the fuel tank cap and check-valve assembly in such a manner that a simple, convenient and compact means of pressurizing a fuel tank is achieved. The body which is threadedly connected to the fuel tank inlet has an aperture which fluidly connects the fuel tank reservior to the hollow check-valve assembly base. When a standard check-valve assembly is inserted into the base, a means is created whereby one may pressurize a fuel tank reservoir by use of a standard air hose. A gasket located in the upper portion of the body between the fuel tank inlet and the bottom of the top of the body contains a slit therein to allow pressurized air to pass from the air hose to the fuel tank reservoir. The gasket prevents pressure leaks by sealing the pressurizing cap and the fuel tank inlet and also prevents fuel from escaping out the top of the check-valve assembly base.

DESCRIPTION OF PREFERRED EMBODIMENT

Figure 1:
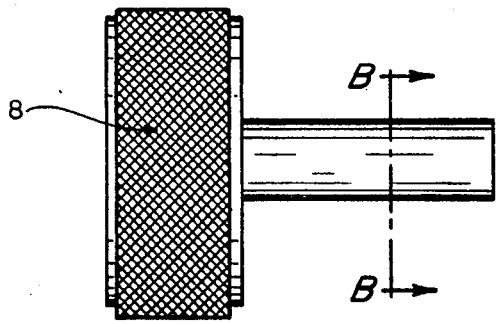
FIG. 1 shows a front-view of the Murray Pressurizing Cap illustrating external features. In normal use the cap is upright with the body (8) on the bottom and the Base (2) toward the top.
Figure 2:
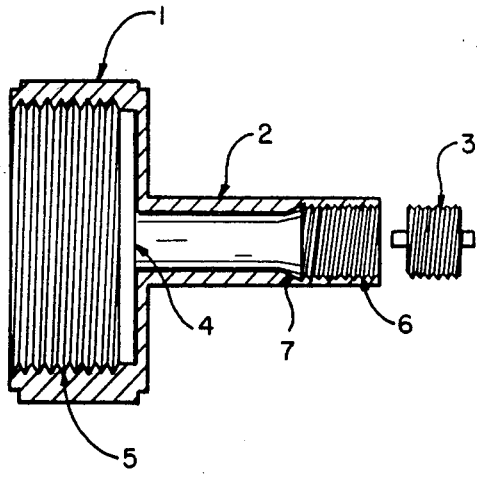
FIG. 2 shows a cross-sectional view taken along line A—A of FIG. 3 and illustrates the inner threads in the body and base as well as the annular seat which is shown in its tapered embodiment.

Referring now to the drawings, FIG. 1 shows the outer structure of the Pressurizing Cap while FIG. 2 shows a cross-sectional view. The Pressurizing cap includes a Body (1) and a Check-Valve Assembly Base (2). When manufacturing this assembly, it has been advantageous to construct the Body and Base separately and then to fixedly attach the Base to the Body by appropriate means. Silver solder has been used effectively but alternate methods of fixedly attaching the Base and Body could be used, for example, welding or glueing. It is also possible to construct the Base and Body as one piece and various suitable means to so do could be used.

Figure 3:
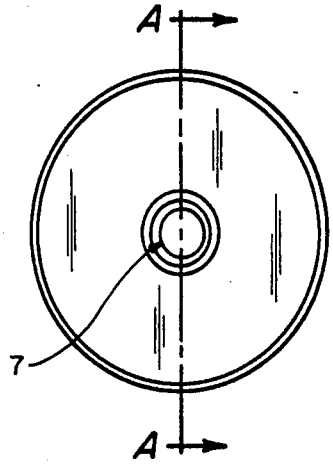
FIG. 3 is an end view.
Figure 4:
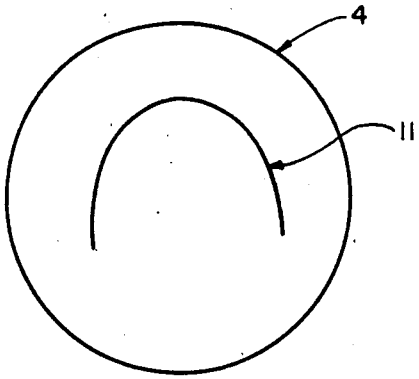
FIG. 4 is a top view of the gasket showing the parabolic slit in the gasket.

The Base (1), as shown, consists of an essentially horizontal flat top having an aperture therein and essentially vertical sides. The aperture allows fluid connection between the hollow Check-valve Assembly Base and the fuel tank reservior. The configeration of the embodiment as shown in FIG. 3 is cylindrical but it could also be of any suitable shape capable to attachment to various fuel tank inlets. For example, the base could have a cylindrical inner surface and a hexagonal outer surface to facilitate tightening the base on the inlet. The embodiment shown in FIG. 1 has a knurled outer surface to facilitate gripping.

The method of attaching the pressurizing cap to the fuel inlet shown is by threading the internal surface (5) of the Body (1), as shown in FIG. 2. Other methods of attachment to the fuel tank inlet are possible. The pressurizing cap could be permanently attached to the inlet by the process of welding or glueing. It is also possible that the pressurizing cap could be a male-designed device and have external threads in place of the knurled surface so as to interconnect to a fuel tank female inlet.

The Check-valve Assembly Base (2) consists of a hollow extension of the body. The base has internal threads (6) which enable the easy insertion and attachment of check valve assembly (3). The check valve assembly is a standard type of assembly such as a Schrader valve and contains external threads. The internal threads (6) on the Base are of a pitch that coincide with the threads on the check-valve assembly. The Base's longitudinal axis is located above the center of the aperture in the Body to allow pressurized air flow from a pressure hose to the fuel tank reservoir when the check-valve assembly is activated.

As shown in FIG. 2, the internal lower portion of the check valve assembly base has an annular ring (7) which forms the valve seat for the check valve assembly seat. The check valve assembly seat has a gasket on its lower surface that sealedly contacts the annular seat (7) of the Base. As shown in FIG. 2, the annular ring is tapered inwardly and downwardly to receive the trapezoidally shaped lower surface of the check valve assembly. Other check valve assemblies, with, for example, flat lower surfaces could be received by modifying the check valve assembly seat in the Base accordingly.

A final component of the pressurizing cap is a gasket (4) located inside the base. In use, this gasket (4) is sealedly pressed against the lower surface of the top of the Base when the base is threadedly attached to the fuel tank inlet. A parabolic slit (1) is made in the gasket to allow pressurized air to flow from the pressurized hose, through the check valve assembly and aperture and into the fuel tank reservior, thus pressurizing the reservoir. The slit in the gasket need not be parabolic, but may be a variety of shapes, for example, linear.

Figure 5:
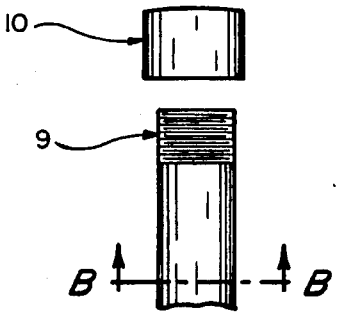
FIG. 5 shows an alternate embodiment of the check-valve assembly base showing the top of the base with external threads and a check-valve assembly base cap.

A second preferred embodiment of this invention includes a Check valve Assembly Base Cap which covers the top of the Base to prevent moisture, dust or other foreign matter from accumulating on the top of the check valve assembly. The embodiment shown in FIG. 5 illustrates one method of attachment of the Base Cap to the Base. External threads (9) are cut into the top of the Base and a Base Cap (10) of standard make may be threadedly attached to the base top when the pressurizing cap is not being used with the pressurizing hose. The Base Cap need not be affixed by threads only but may also be attached and held in place by friction only, in which case no external threads are required and the Base Cap need likewise not be threaded.

In the preferred method of manufacture the check valve assembly (3) to be inserted is first selected. The Check-valve Assembly Base (2) is then machined so that the internal base threads (6) and the internal base annular seat (7) are compatible with the check valve assembly seat. The Body (1) is selected so as to be compatible with the particular fuel tank inlet both as to the size of the internal cavity of the body and as to the internal body threads (5). The outer surface of the body is then machined to provide the correct knurl (8) on the outer surface. A gasket containing a slit is then formed so as to cover the entire lower inner surface of the top of the Body.

The base is connected to the body so that the hollow area of the base coincides with the aperture of the body. The checkvalve assembly is inserted, tightened and sealedly affixed. The entire unit may then be sealedly attached to the selected fuel tank inlet.

I claim:

1. A camp stove or camp lantern fuel tank reservoir cap and pressurizing assembly comprising:
   (a) a body having a top and sides, said top having an aperture therein, adapted to be threadedly attached to a camp stove or camp lantern fuel tank reservoir inlet;
   (b) a hollow check-valve assembly base having an internal annular valve seat surface. The bottom surface of said base being fixedly and sealedly attached to the upper surface of the top of said body, the longitudinal axis of said base being substantially aligned with the center of said aperture;
   (c) a check-valve assembly sealedly attached inside said check-valve assembly base;
   (d) a gasket having a slit therein located inside said body and immediately below and sealedly in contact with said top and being co-extensive with the top thereof, whereby a single discontinuous application of pressure from a standard air pressure hose will pressurize said camp stove or camp lantern fuel reservoir for a period of time.

2. A camp stove or camp lantern fuel tank reservoir cap and pressurizing assembly as in claim 1, wherein the outer surface of the body has a knurled surface.

3. A camp stove or camp lantern fuel tank reservoir cap and pressurizing assembly as in claim 1, wherein the internal annular valve seat surface taper inwardly and downwardly to receive the check-valve assembly seat.

4. A camp stove and camp lantern fuel tank reservoir cap and pressurizing assembly as in claim 1, wherein said body is permanently attached to said fuel tank reservoir inlet.

5. A camp stove and camp lantern fuel tank reservoir cap and pressurizing assembly as in claim 1, wherein the hollow check-valve assembly base is tubular.

6. A camp stove and camp lantern fuel tank reservoir cap and pressurizing assembly as in claim 1, wherein the upper portion of the check-valve assembly base has outside threads adapted to receive a cap, further comprising a check-valve assembly base cap.

7. A camp stove and camp lantern fuel tank reservoir cap and pressurizing assembly comprising:
   (a) an essentially cylindrical body having an essentially horizontal top with an aperture therein and essentially vertical sides, the inner surface of said sides being threaded to attach to a camp stove or camp lantern fuel tank reservoir inlet;
   (b) a vertical tube essentially perpendicular to said horizontal top having an upper section with threads on the internal surface thereof and having an internal annular valve seat surface, the bottom of said tube being fixedly connected to the upper surface of said horizontal top whereby the longitudinal axis of said tube is substantially aligned with the center of said aperture;
   (c) a check-valve assembly threadedly attached on the inside of said vertical tube, the bottom surface of said assembly sealedly in contact with the internal annular surface of said tube;
   (d) a gasket having a slit therein located below the lower surface of said horizontal top and sealedly in contact therewith, and being co-extensive with the top thereof, whereby when said camp stove or camp lantern fuel tank reservoir cap is threadedly attached to a male fuel tank reservoir inlet said fuel tank reservoir inlet may be pressurized by a single discontinuous application of pressure from a standard air pressure hose for a period of time.

8. A camp stove and camp lantern fuel tank reservoir cap and pressurizing assembly as in claim 7, wherein the outer surface of said body has a knurled surface.

9. A camp stove and camp lantern fuel tank reservoir cap and pressurizing assembly as in claim 7, wherein the internal annular valve seat surface tapers inwardly and downwardly to receive the check-valve assembly seat.

10. A camp stove and camp lantern fuel tank reservoir cap and pressurizing assembly as in claim 7, wherein said body's permanently attached to said fuel tank reservoir inlet.

11. A camp stove and camp lantern fuel tank reservoir cap and pressurizing assembly as in claim 7, wherein the upper section of said tube has external threads thereon, further comprising a check-valve assembly base cap.

* * * * *